United States Patent [19]

Clancey et al.

[11] Patent Number: 4,835,405

[45] Date of Patent: May 30, 1989

[54] GENERATOR SET AND METHOD

[75] Inventors: Stephen M. Clancey, Moundsview; Stanely D. Hjelmstad, Minneapolis; Mark S. Lent, Golden Valley; Michael C. Miller, Coon Rapids, all of Minn.

[73] Assignee: Onan Corporation, Minneapolis, Minn.

[21] Appl. No.: 126,923

[22] Filed: Nov. 30, 1987

[51] Int. Cl.[4] ..... F02B 63/04

[52] U.S. Cl. ..... 290/1 A; 290/1 B

[58] Field of Search ..... 290/1 R, 1 A, 1 B; 322/1; 123/2, 3

[56] References Cited

U.S. PATENT DOCUMENTS

| | | | |
|---|---|---|---|
| 4,548,164 | 10/1985 | Ylonen et al. | 290/1 B X |
| 4,595,841 | 6/1986 | Yaguchi | 290/1 B X |
| 4,608,946 | 9/1986 | Tanaka et al. | 290/1 B X |
| 4,622,923 | 11/1986 | Nishimura et al. | 290/1 B X |
| 4,647,835 | 3/1987 | Fujikawa et al. | 290/1 B X |
| 4,702,201 | 10/1987 | Odo et al. | 290/1 A X |
| 4,721,070 | 1/1988 | Tanaka et al. | 290/1 B X |

*Primary Examiner*—William M. Shoop, Jr.
*Assistant Examiner*—W. E. Duncanson, Jr.
*Attorney, Agent, or Firm*—Merchant, Gould, Smith, Edell, Welter & Schmidt

[57] ABSTRACT

A generator set including an internal combustion engine which drives an alternator or generator to generate electricity. The engine and the generator are air cooled by air driven by a fan along two parallel air cooling circuits through the generator set. The components of the set are enclosed in a two-piece housing or enclosure having two openings, an air inlet and an air outlet.

20 Claims, 11 Drawing Sheets

LOOP BLOCK DIAGRAM

REACTIVE FREQ. SENSING

GENERATOR SET AND METHOD

FIELD OF THE INVENTION

The present invention relates to a mobile generator set for use to supply electrical energy for various purposes including generating electricity for recreational vehicles (RVs).

BACKGROUND OF THE INVENTION

Portable internal combustion engines have been used to drive electric generators which convert the mechanical energy of the engines into electricity for use in the field for many purposes. Generator sets of this type include a small engine similar to those used for a lawn mower or the like which is used to drive a generator which produces electricity. However, most of these devices are quite noisy. Since they must be run continuously to supply electricity for many uses, the noise made by the internal combustion engine is unsuitable for many purposes, including use in a residential area. Although attempts have been made to enclose or house prior generator sets, these attempts have not been entirely satisfactory because, in addition to other problems, the amount of noise reduction is not sufficient to effectively quiet the noise from the internal combustion engine; noise abatement structures applied external to the generator set result in a bulky and expensive noise control system; enclosures or housings supplied to reduce noise tend to vibrate, thereby resulting in secondary noise emissions; and, problems have been experienced with the air cooling systems in such enclosed generator sets.

Therefore, a need exists for a quiet generator set. Where attempts are made to enclose the internal combustion engine of a generator set a need exists for an efficient cooling system to keep the working parts of the internal combustion engine and the generator cool during operation so that they do not overheat and prematurely malfunction.

The present invention provides solutions to these problems and offers other advantages over the prior art and solves other problems associated with the prior art.

SUMMARY OF THE INVENTION

The generator set of the present invention is configured to minimize the airborne noise produced by the unit.

Prior art generator sets having conventional construction generally provide a generator attached to the normal power take off (PTO) side of the engine where the exhaust also comes out. The generator cooling system suffers because the hot engine exhaust is on the air discharge side of the generator and the two cooling systems are fighting each other. The engine will generally have a vertical cylinder construction just as the original engine for the generator set was intended to be. The engine cooling fan and the ignition system are generally on the cold side of the engine, as is the carburetor. The lubrication system for the engine is a splash lubrication system appropriate for a vertical cylinder engine. The carburetor position and intake mounting will be as is generally appropriate for a vertical cylinder engine. Such an engine design is quite typical of any engine in the turf market, i.e., the grass maintenance market, the snow blower market, or the small agricultural machine market.

In one embodiment of the present invention, the engine for the generator set of the present invention is a modification of an existing engine that was used for agricultural purposes. The cylinder has been put in a horizontal position as opposed to the original engine having a vertical cylinder. This vertical orientation required modification of several internal engine features. For example, the engine lubrication system was modified so that it would lubricate the engine in the horizontal position.

In the preferred embodiment the generator set housing or enclosure serves as a sound attenuating enclosure. The use of a sound attenuating housing allows a much simplified installation of the unit in its intended application in recreational vehicles. In the past, the vehicle manufacturer has applied noise abatement treatments external to the generator set. This results in a bulky and expensive noise control system.

To minimize noise "leaks", in a preferred embodiment, only two openings for ventilation exist during operation. The material for the housing and its geometrical properties which affect stiffness and mass per unit area are carefully chosen to optimize the transmission loss of noise through the housing. Curves of transmission loss versus frequency of noise for a structure typically have a low point at the frequency corresponding to the natural frequency of vibration of the first bending mode of the structure. Choice of material and shape can move this low point higher or lower on the frequency scale. Knowledge of the spectrum of noise generated by the internal working components of the generator set allows the tailoring of the properties of the housing for optimization of transmission loss.

In the preferred embodiment, the exhaust muffler for the engine exhaust is contained within the integral housing. This differs from the common practice of mounting the muffler remote from the generator set and exposed. Placing the muffler inside the generator set housing improves on standard practice in several ways. First, the noise radiating from the outer surface of the muffler body is acted upon by the housing and undergoes a transmission loss. Secondly, the mass of the muffler is always in the same position relative to the engine and therefore the performance of the vibration isolation system is consistent and not subject to variation caused by differing muffler placements. Thirdly, the installation of the generator set in the recreational vehicle is simplified because no muffler mounting is required.

In addition to the generator set housing, the preferred embodiment employs other noise control treatments. The "line of sight" path to noise sources at the two enclosure openings is blocked by the geometric design of the air inlet area and by the addition of baffling to block this noise path in the air discharge area.

In the preferred embodiment, sound absorbing materials are used internal to the generator set housing to dissipate sound energy and minimize the build-up of standing sound waves within the housing. Polymeric acoustical foam and glass fiber materials are used in the cooler areas of the generator set and fibrous high temperature materials are used near the hot parts of the engine.

A preferred embodiment of the present invention has a cooling system which is unique in several ways. Both the engine and generator are cooled by air flowing from a single fan located at the air inlet end of the generator set. The fan cooperates with a fan shroud and an end bell to direct the cooling air along to parallel air flow circuits, one to cool the engine and the other to cool the generator and then the engine oil pan. The cooling air then comes together to cool the muffler at the air outlet end of the generator set, just before it leaves the enclosure. This fan is driven by an extension of the generator shaft remote from the engine crankshaft where the engine cooling fan is typically driven. The generator cooling air is forced behind the cooling fan through the generator and across the finned engine oil pan or oil sump. The engine cooling air is routed through an air duct along the side of the generator, and across the engine cylinder finning and cylinder head. This cooling configuration offers several advantages over typical generator set cooling system designs, including lower parts count and cost, and a design providing a single inlet and a single outlet for cooling air, which simplifies and facilitates noise control.

In the preferred embodiment, a special engine configuration is used. The engine is a modification of an existing design. The following changes are made to facilitate this design: (1) the engine is rotated 90° to provide a horizontal cylinder; (2) the generator drive is provided on the opposite side of the engine from what is usually standard; (3) the crankshaft is modified to allow the drive end change; (4) the standard cooling system and ignition hardware are deleted; (5) an enlarged and finned oil sump is added to facilitate engine oil cooling inside the generator set housing; (6) a special magneto ignition is designed to allow placement at the fan end of the generator; (7) a special carburetor and inlet tube is designed; (8) a special governor linkage is designed; (9) special muffler mounting features are added; and (10) special generator mounting features are added.

The engine vibration transmitted to the generator set housing is typically a significant source of noise. This structure-born vibration can excite the housing to vibrate, thereby generating airborne noise. To prevent this, the generator set of the preferred embodiment employs a special mounting system. This system uses elastomeric mounts in a focalized mounting system. In a focalized system the elastic center of the isolators coincides with the combined center of gravity of the engine and generator. A modified focalized system is employed on the generator set of the present invention. The horizontal single cylinder engine produces a large "rocking" force about a line through the centers of gravity of the generator and the engine. The elastic centers of the mounts are focused on this line rather than through the point defined by the composite center of gravity. The result is very low transmitted vibration and low noise radiated from the generator set housing.

The overall weight of the preferred generator set 10 is about 110 pounds. Of this weight, the preferred generator 40 weighs only about 75 pounds. This provides a significant weight advantage over competitive products. A competitive portable generator set of comparable kilowatt output generally weighs considerably more.

The noise level of the preferred generator set 10 is about 70–85, preferably about 75–80, most preferably about 78 dBA at one meter. A "dB" is a logarithmic noise scale and the "A" portion of the "dBA" refers to an A weighting scale industrial standard for measuring noise. Competitive products with competitive kilowatt outputs range from about 86–92 dBA. Therefore, the present invention offers a very significant noise reduction over competitive products. The preferred generator set of the present invention produces 2.8 kilowatts of electrical output. An alternate embodiment produces 2.2 kilowatts. The engine and the generator are essentially identical for each of the two embodiments. The major difference is the size of the circuit breaker. The two model sizes were selected for marketing strategy reasons to allow more effective competition in the marketplace at two different pricing levels. It will be appreciated that other embodiments having other kilowatt outputs can be provided while remaining within the scope of the present invention.

As used herein, the radius of the shroud means that an inside wall of the shroud expands outward so that the radius of the shroud coincides with the distance between the center of the fan located in the shroud and the inside wall of the shroud.

The above described features and advantages, along with various other advantages and features of novelty, are pointed out with particularity in the claims of the present application. However, for a better understanding of the invention, its advantages, and objects obtained by its use, references should be made to the drawings which form a further part of the present application and to the accompanying descriptive matter in which there is illustrated and described a preferred embodiment of the present invention.

BRIEF DESCRIPTION OF THE DRAWINGS

In the drawings, in which like reference numerals and letters indicate corresponding parts throughout the several views;

FIG. 5 is a top plan view of the base of the generator set shown in FIG. 1;

DETAILED DESCRIPTION OF THE PREFERRED EMBODIMENT OF THE PRESENT INVENTION

Figure 1:
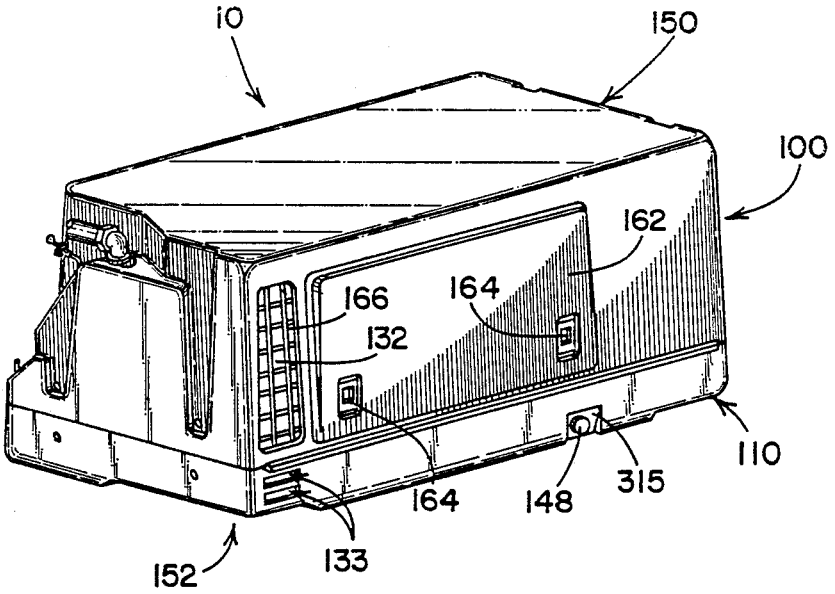
FIG. 1 is a perspective view of a preferred generator set in accordance with the present invention.
Figure 5:
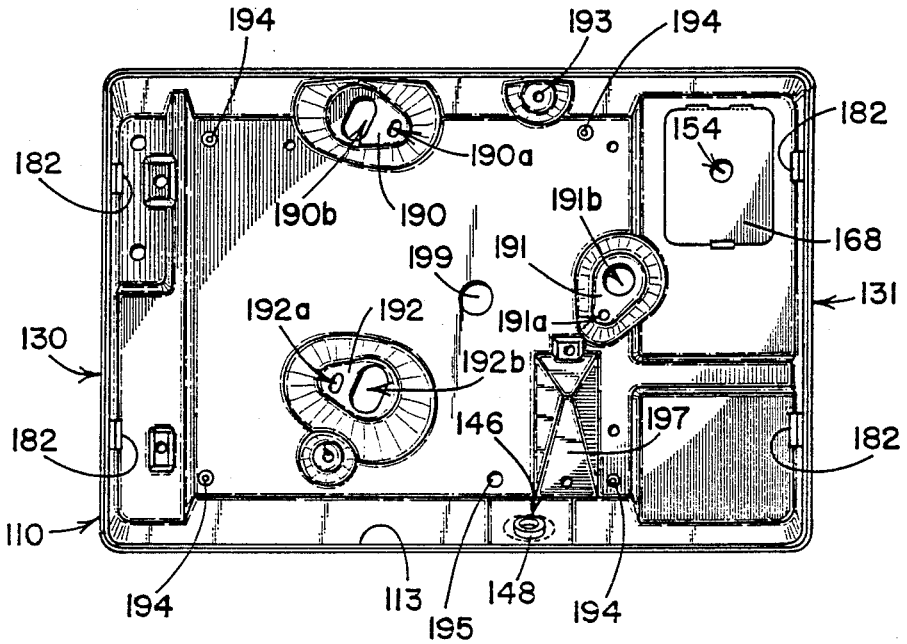
FIG. 5 is an exploded perspective view of the generator set shown in FIG. 1.
Figure 2:
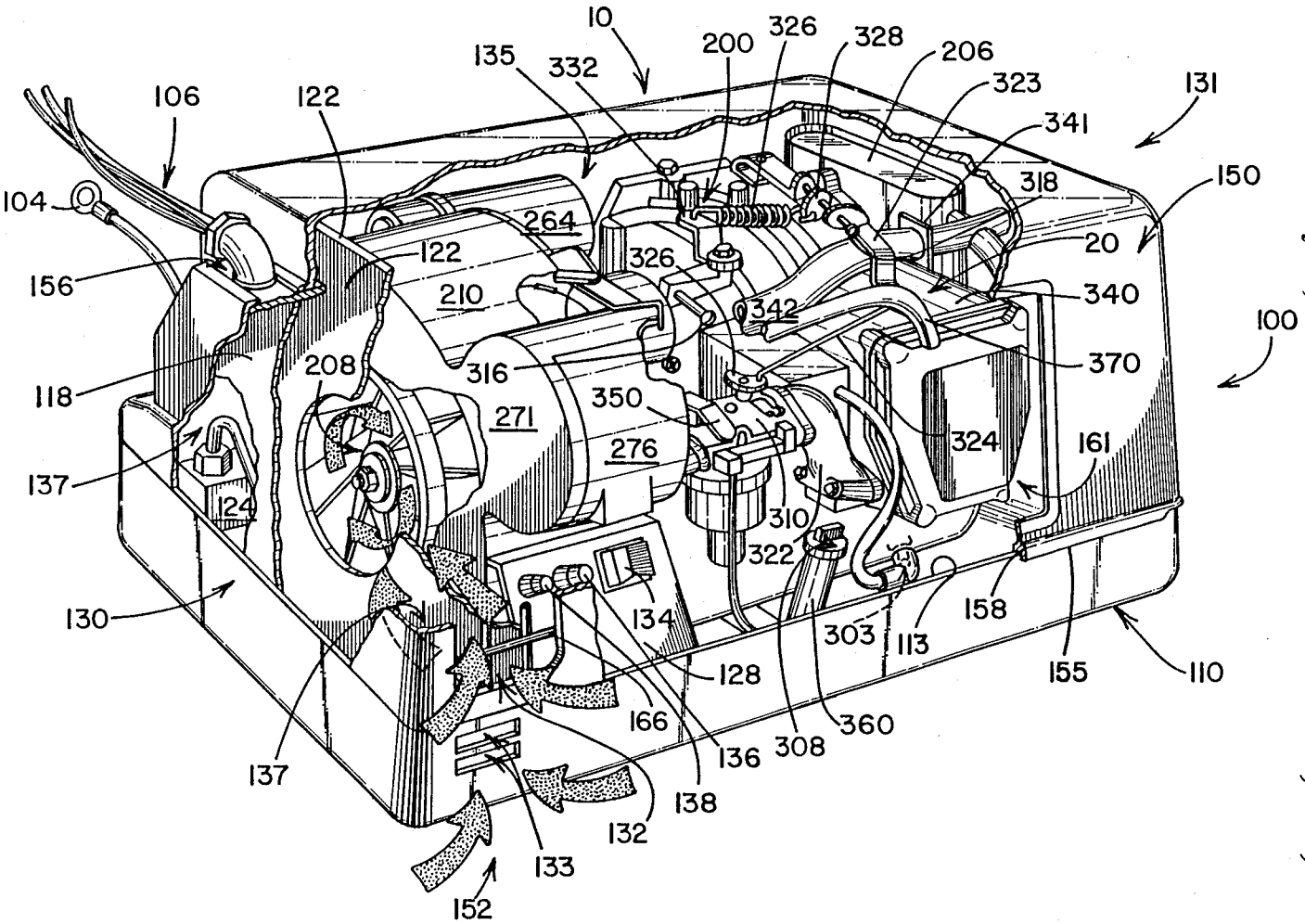
FIG. 2 is a perspective view of the generator set shown in FIG. 1 with portions being cut away for purposes of illustration.
Figure 3:
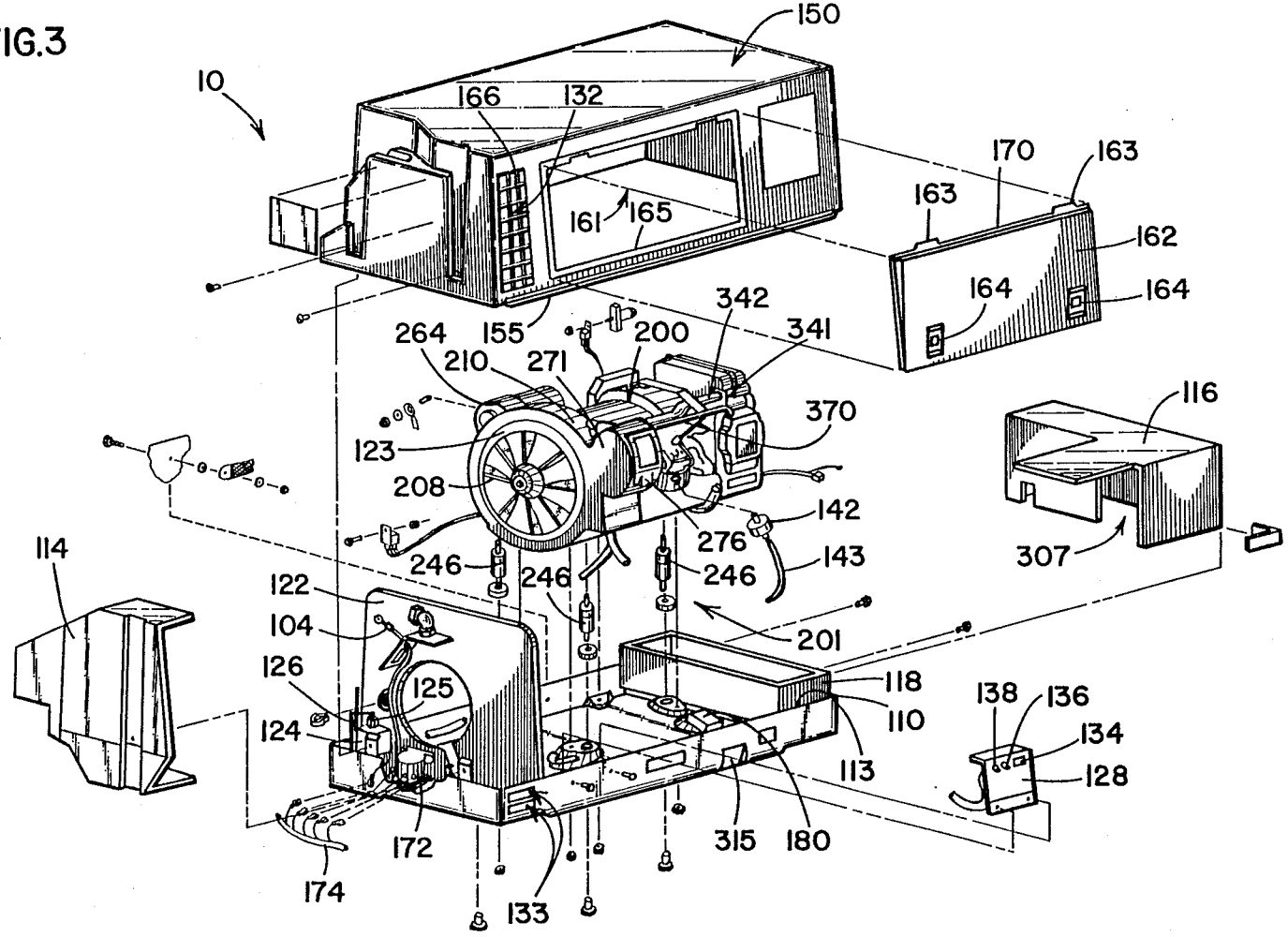
Figure 4:
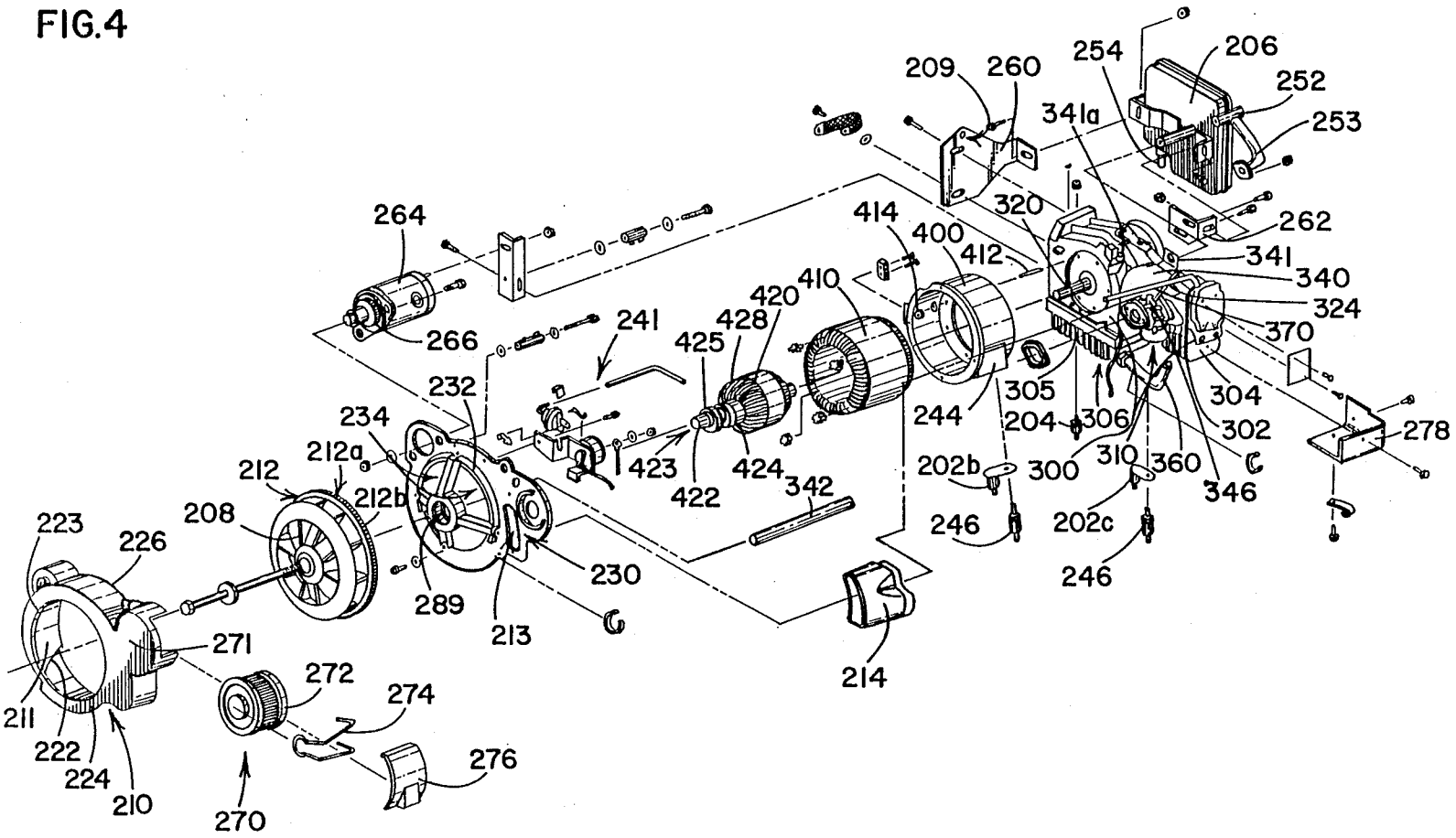
FIG. 4 is an exploded perspective view of the components within the generator set enclosure of the generator set shown in FIG. 1.

Referring now to the drawings, and particularly to FIGS. 1-5, which show a preferred embodiment of a generator set 10 of the present invention, FIGS. 3-4 show exploded perspective views of the preferred generator set 10 provided by the present invention. The generator set 10 includes a gasoline driven, internal combustion engine 20 which drives a generator 40, both of which are cooled by air directed to them by an air cooling system (further described hereinbelow), all of which is self-contained within a housing or enclosure 100. The generator set 10 is used to supply electrical power to operate various electrical devices, preferably those found in a recreational vehicle (RV), such as air conditioners, appliances, lighting, and the like. The prime mover is the internal combustion engine 20 which is air cooled and has a single cylinder, four cycle, overhead valve design. This engine 20 was originally designed as a vertical cylinder engine, as is standard in various industrial or agricultural applications. The engine 20 of the present invention was specially modified to be used in the generator set 10 of the present invention.

When the generator set 10 is installed in an RV, several connections must be made. A battery from the RV must be attached in order to provide power to a starter motor 264 so that the engine 20 may be started. When the engine 20 is started, it drives or rotates a portion of the generator 40 which produces alternating current (AC) electrical power. The portion of the generator 40 which rotates or spins is a revolving field type of alternator 420. The generator 40 also produces a rectified direct current (DC) power to recharge the battery, thereby replacing the power that was drawn from the battery in order to start the engine 20. This is accomplished using a rectifier in a separate winding on the generator 40.

The generator set 10 includes a two-piece enclosure or housing 100 used to enclose the engine 20, the generator 40, and the other working parts of the generator set 10. The two-piece housing includes a base 110 and an upper portion or cover 150. The base or base portion 110 of the housing 100 is made of drawn sheet metal which offers structural integrity by taking advantage of the sheet metal's properties with respect to elongation of an ability to stretch and bend during a crash impact. This allows the generator set 10 to meet Federal Motor Vehicle Safety Standard Crash requirements. The cover 150 is a plastic sheet molding compound, preferably a glass reinforced polyester material. The main purpose of the two-piece housing 100 is to contain noise that is emitted from the engine 20, which operates within the housing 100.

Care is taken in gasketing the surfaces where the cover 150 and the base 110 come together, in order to provide a releasable seal which effectively reduces the noise which passes through the areas where the surfaces meet. A single air inlet 152 for the cooling air, as well as a single air outlet 154 for cooling air which has passed over hot surfaces within the generator set 10 are provided. This allows the acoustical treatments to be concentrated in two areas of the generator set 10 near the inlet 152 and the outlet 154. Therefore, the areas where noise can potentially leak out of the generator set 10 are minimized.

The upper portion 150 of the housing 100 includes a panel opening 161 for receipt of a large service panel 162 in the front of the generator set 10. This panel 162 is well gasketed so that it may be releasable sealed to the upper portion 150 in order to reduce the amount of noise released from the housing 100 through the opening 161 for receiving the service panel 162. The service panel opening 161 allows easy access for routine maintenance and for servicing various parts of the engine 20 and the generator 40. The panel 162 is easily removed using two latches or catches 164 which release the lower edge 165 of the service panel opening 161.

Many of the component details of the generator set 10 of the present invention are designed to make them cost effective. For example, the single air inlet 152 and the single air outlet 154 allow the internal acoustical treatments of the generator set 10 to be very cost effective because these are the only two areas which are open to the outside when the service panel 162 is in place. Therefore, these are the only major areas requiring acoustical treatment. This lowers production costs, as compared with other designs which require acoustical treatment in multiple areas. In addition, the service panel 162 has a low cost hinge mechanism. Simple sheet metal tabs or hinges 163 are used to restrain the upper edge 170 of the panel 162 when the panel 162 is engaged in the service panel opening 161. Low cost plastic latches 164 are used to snap fit into catch openings (net shown) in the metal stamping used to make the panel 162, so that multiple features are derived from a single stamping. The panel 162 is also deformed to include the tabs or hinges 163. Once the latches 164 are snapped into the panel 162, the panel 162 may be easily engaged in the panel opening 161 in upper portion 150 of housing 100. Therefore, the service panel 162 having multiple features is easily manufactured cost effective.

The sheet metal base 110 is a drawn or stamped part. Because base 110 is a sheet metal stamping, many features can be provided in the drawn component. Base 110 is very complex and has multiple functions. It supports the engine mounts 202, 204, it supports acoustical materials 114, 116, 118; and it is the structural member for mounting the generator set 10, either in a conventional manner above the floor, or in an alternate manner for an under the floor installation. Base 110 also holds an air inlet baffle 122 which acts as a noise barrier.

The air inlet baffle 122 is also a multi-functional part which holds the fuel pump 124, provides acoustical functions, cooling functions, and holds all of the fuel system and electrical interfaces. The fuel system and electrical interfaces include a hose fitting (not shown) for the fuel pump 124, a battery connection 104, an alternating current (AC) output connection 106, and a remote control or remote operating connection (not shown). The hose fitting or fuel connection, the remote operating connection, the battery connection 104, and the AC outlet or output connection 106 are all located in the same area of the housing 100 for ease of installation and are accessible through an opening 156 that is molded into the cover 150. The AC outlet 106 is the alternating current attachment point for wiring the generator set 10 to the RV or such other devices as are to be supplied with electrical power.

The housing cover 150 has bottom edges 155 including troughs 158 molded into edges 155 to retain gasket material (not shown) which is engaged in troughs 158 such that the gasket material releasably seals the bottom edges 155 of cover 150 to edges 113 of the base 110 such that the noise which escapes from enclosure 100 through these joints is minimized. This feature allows efficient sealing between the cover 150 and the base 110 which not only limits the amount of noise which escapes from within housing 100, but also provides for an efficient use of the cooling air within the housing 100.

The single air inlet 152 on the front of the housing 100 includes an air inlet opening 132 in the cover 150 covered by an air inlet grill 166 and two smaller rectangular air inlet openings 133 in the base 110. The inlet grill 166 is suitably fastened over the inside of the air inlet opening 132 as a safety feature to keep fingers and the like out of the fan 208.

In designing the housing 100 so that the noise emitted from generator set 10 is minimized, a number of factors must be considered. The engine 20 will have an exhaust system including a muffler 206 which generates heat. Noise is radiated from surfaces 300 of engine 20. A fan 208 is included to provide air cooling. This fan 208 can also create a high frequency noise.

In order to minimize the noise which is emitted from the housing 100, it must be designed to utilize materials which absorb noise within the housing 100. Efforts were made to design the housing 100 to minimize the size and the number of the openings to the outside. Where there are joints or seams which are closed to the outside, the joints are equipped with gaskets or seals so that surfaces that come together to close the joints are releasably sealed, and thereby limiting the noise which escapes. The two major areas in the housing 100 which are not closed to the outside are the air inlet 152 including air inlet openings 132, 133 and the air outlet 154 for the muffler exhaust and spent cooling air. These openings are actually at opposite ends of interconnected ducts which are fashioned by the shapes created by the housing 100 and its contents when the base 110 and the cover 150 are joined. These duct areas, are most defined at an air inlet end 130 and at an air outlet or exhaust end 131 of the housing 100 where they are treated by molded fiberglass insulating parts 114, 116, 118 which are covered with aluminum foil facing. The insulating parts 114, 116, 118 absorb noise energy within the housing 100, and therefore reduce the amount of noise which can be emitted to the outside through the air inlet 152 and the air outlet 154.

At the exhaust end 131 of housing 100 the parts 116, 118 that function as noise absorbers also function as heat insulators to insulate other portions of the generator set 10 from the heat emitted from the muffler 206, thereby preventing the housing 100 from becoming too hot. The molded fiberglass insulation parts 114, 116, 118 absorb noise and also help to minimize the transfer of heat to the housing 100, especially the molded cover 150, thereby helping to maintain the skin temperature of housing 100 and the cover 150 within prescribed limits.

The general internal layout of the components within the generator set 10 was designed to accommodate two important factors. One factor was the serviceability of those components which require occasional servicing, and the other factor was management of heat distribution within the housing 100. The general layout provides for a heat gradient wherein the heat producing components are generally located at the air outlet end 131 while the heat sensitive parts are generally located at the air inlet end 130 of generator set 10. The fuel pump 124, which cannot withstand high temperatures without having vapor lock problems, is positioned here because this is the coolest end of the set 10. Also, because it is not a frequently serviced part, it is put in a location without regard to service access. As one moves from the relatively cooler, air inlet end 130 of the generator set 10, the interior of the housing 100 is partially separated by an air baffle or bulkhead 122 which helps to contain noise from the generator 40 and the engine 20, and also keeps hot air from the engine-generator compartment 135 from recirculating to the cooler air inlet compartment 137 just inside the air inlet 152. Moving away from the air inlet end 130, adjacent to the bulkhead or baffle 122 is a cooling fan 208 which is enshrouded in its own casing or fan shroud 210. The shroud 210 includes a shroud gasket 123 made of an extruded flexible polymeric material. The gasket 123 is attached to the shroud 210 and abuts against the baffle 122 such that air is drawn into the fan 208 from the air inlet compartment 137.

Figure 6:
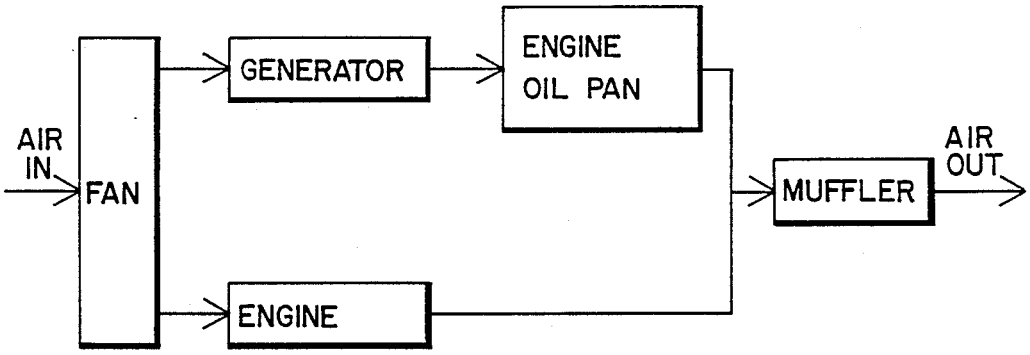
FIG. 6 is a diagrammatic illustration of the air cooling system of the generator set shown in FIG. 1.
Figure 7:
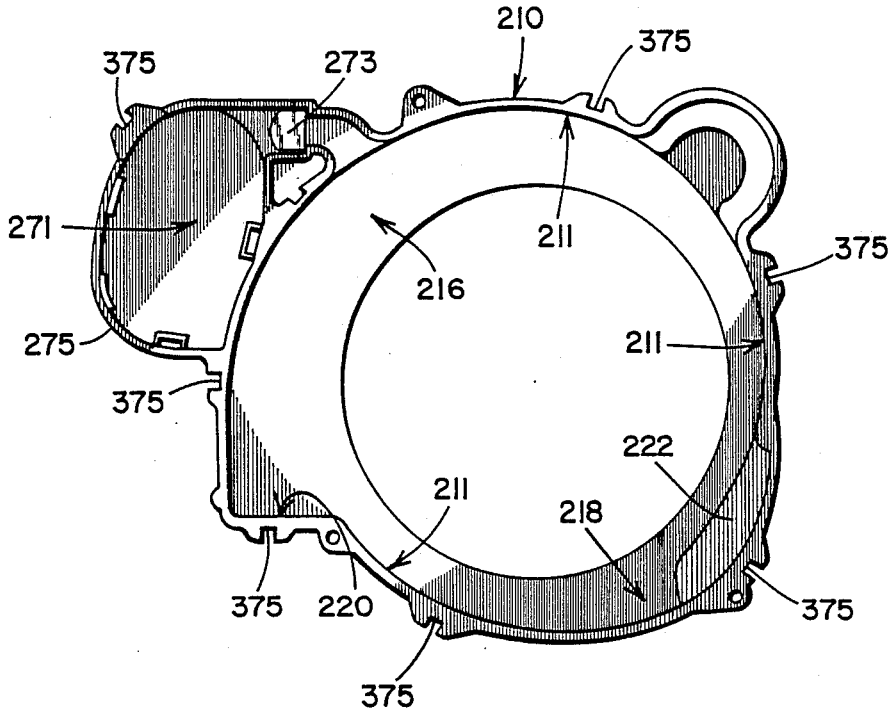
FIG. 7 is a plan view of the inside of the fan shroud of a preferred embodiment of the present invention.
Figure 8:
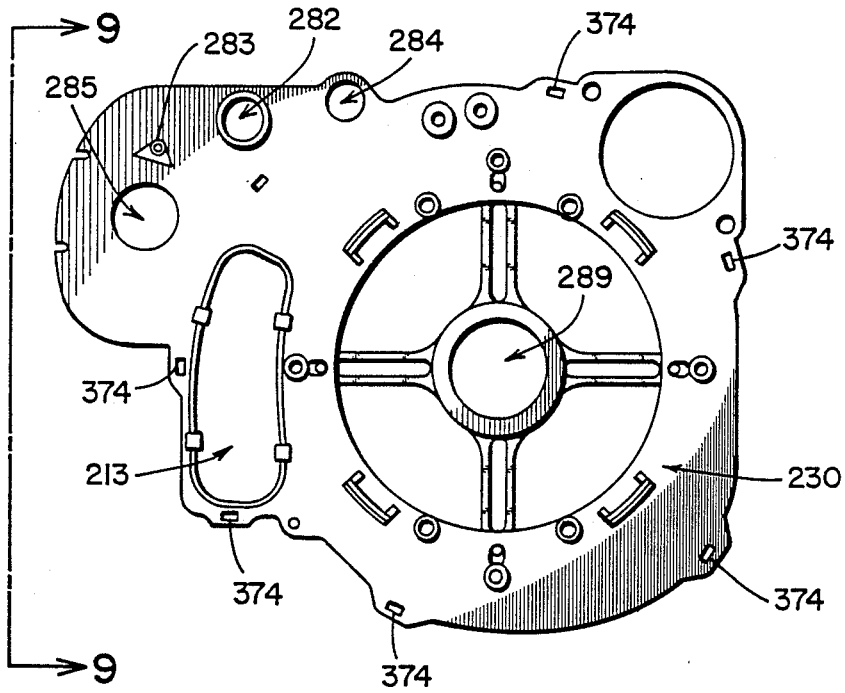
FIG. 8 is a side view of the end bell of a preferred embodiment of the present invention.
Figure 9:
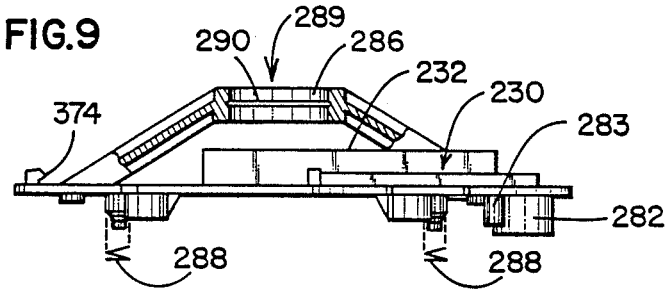
FIG. 9 is a plan view of the side of the end bell which faces the generator.

The fan 208 draws air through the air inlet 152 into the air inlet chamber 153 from the outside. The air is then drawn into the fan 208 radially outward as the fan 208 spins in a clockwise manner. The fan shroud 210 is shaped to form two non-symmetrical volutes 216, 218 which direct the cooling air to two parallel cooling paths which pass through the interior of the generator set 10 as show diagrammatically in FIG. 6.

Referring now also to FIGS. 7–11, the volutes 216, 218 are areas in the molded fan shroud 210 where the radius from the fan center **208*a* to the inside wall 211 of the shroud 210 gradually increases until it is abruptly narrowed by a ridge or an abutment wherein the increasing radius and the volutes 216, 218** end.

The larger of the two volutes 216 begins along the perimeter of the fan 208 on one side of the shroud 210 and the radius continues to increase until it comes to an abrupt narrowing at an abutment 220 on the other side of the shroud 210. As the wall 211 continues around the shroud 210 after the abutment 220, the radius begins to increase again as the smaller of the two volutes 218 begins to grow in size. The inside wall 211 of the shroud 210 continues to expand outwardly as the radius increases in the smaller volute 218, until the radius is narrowed by a raised ridge 222 which slants downwardly from the top 224 of the shroud 210 to the base 226 of the shroud 210.

Figure 10:
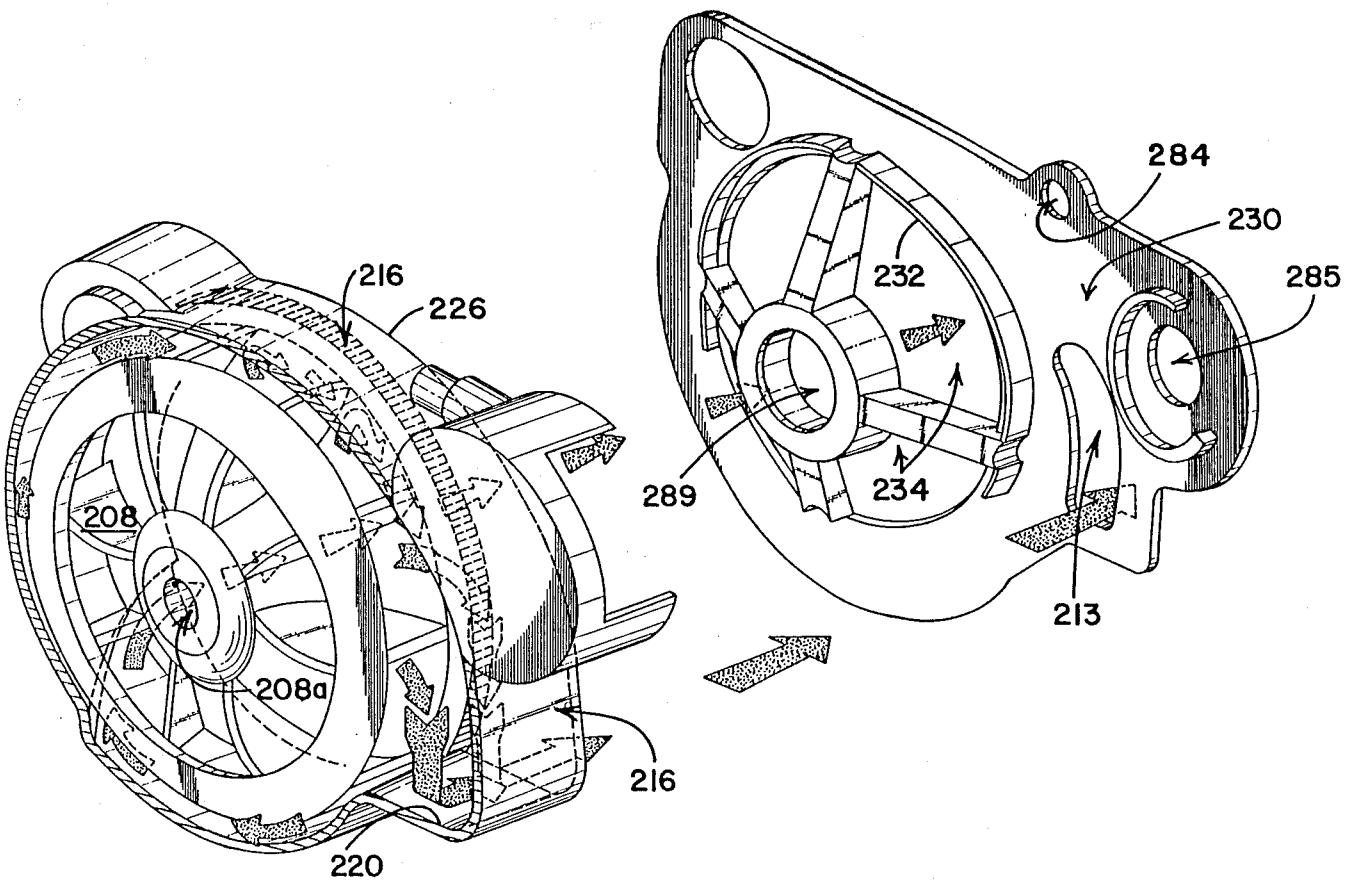
FIG. 10 is an exploded perspective view of the fan and the end bell with the fan shroud shown partially in phantom and showing arrows illustrating the air flow pattern of the cooling air to the generator and the engine.
Figure 11:
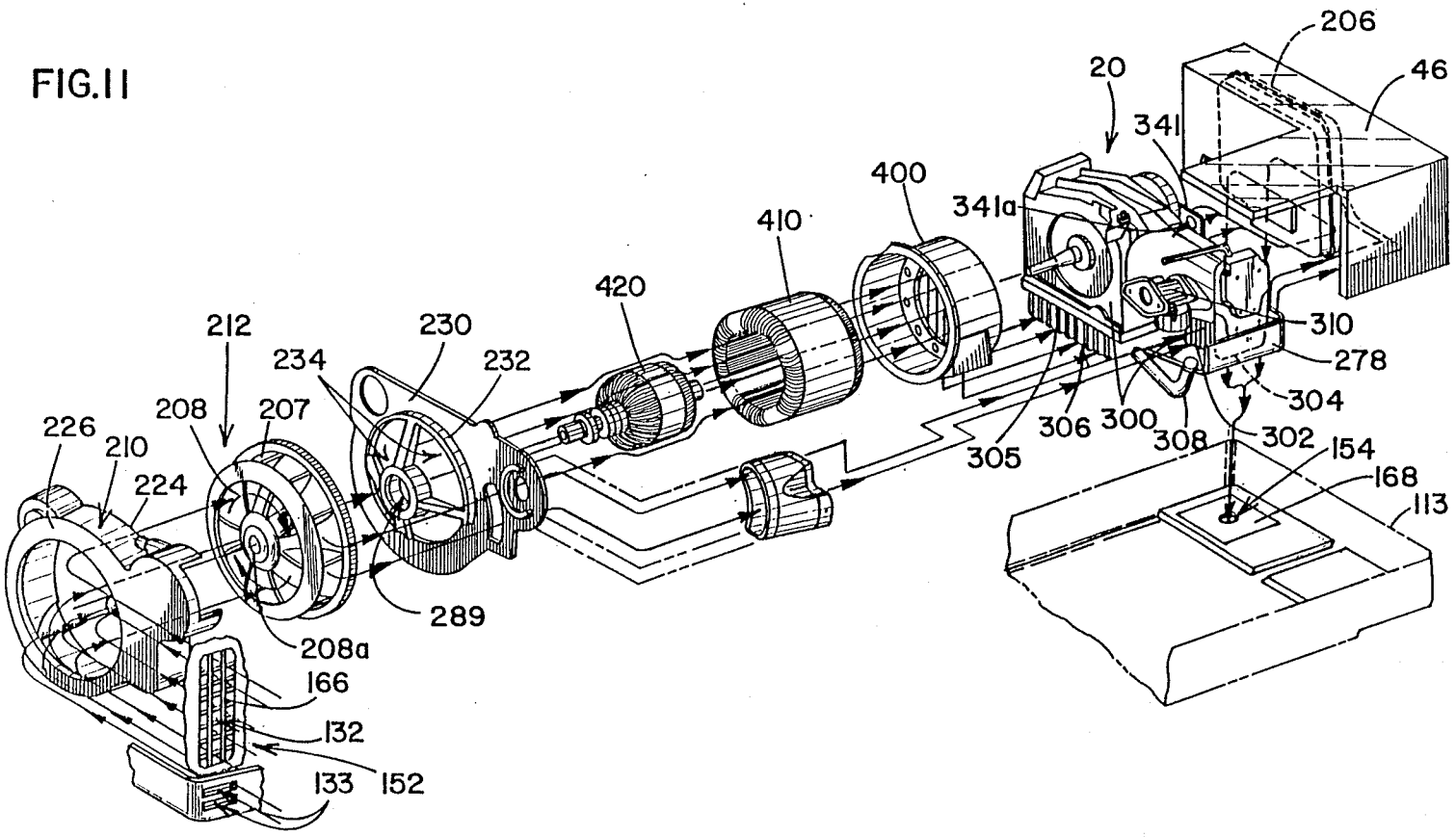
FIG. 11 is an exploded perspective view of the major components of the generator set showing arrows which illustrate the air flow patterns of the air cooling system.

As shown in FIGS. 2, 10 and 11, the fan 208 spins clockwise, drawing air into the fan 208 through the air inlet 152. As the fan 208 spins, it drives the air radially outward against the inside wall 211 of the shroud 210. When the air is driven against the inside wall 211, it flows clockwise along the inside walls 211 proximate the two volutes 216, 218 which expand outwardly as the radius increases in each of the volutes 216, 218. The cooling air in the larger volute 216 flows along the inside wall 211 until it reaches the abutment 220. When it reaches the abutment 220 the, air makes a right angle turn and goes through the air duct opening 213 in the end bell 230 an into the air duct 214 which directs the air onto the hot surfaces of the engine 20. A raised wall 232 cast into the end bell 230 prevents the cooling air that is flowing through the larger volute 216 from passing through the center opening 234 in the end bell 230, which would allow the air to pass into the generator stator housing 400 to cool the generator 40.

The cooling air directed to the generator 40 is drawn off the fan 208 in the lower one-third segment of the fan perimeter proximate or adjacent to the smaller volute 218. A raised ridge 222 in the smaller volute 218 cooperates with the shroud 210 and a raised wall 232 cast onto the generator end bell 230 around the center opening 234 in areas not proximate to the smaller volute 218, to force the air built up in the lower one-third segment of the fan perimeter adjacent the smaller volute 218 to pass through the lower segment of center opening 234. From there, the air passes through the generator 40 and down below the oil pan 306, up the other side of the engine 20 where it merges with the air cooling the engine 20 and passes out of the air outlet 154 after passing over the hot surfaces of the muffler 206, which is thereby cooled. The non-symmetrical configuration of these volutes was chosen to optimize the performance of the cooling system in the present invention.

The cooling air for engine 20 is taken from the upper two-thirds of the perimeter of the fan 208. The upper portion 236 of the fan shroud 210 collects this air in the larger volute 216 and directs it through the air duct opening 213, into the air duct 214, and onto the engine cylinder 302 and the cylinder head 304. When the air cooling the generator components exits the generator 40, it is a finned oil pan or oil sump 306. The oil pan 306 is fastened to the bottom of engine 20 where the engine lubricating oil is kept. The air which exits the generator 40 and cools the finned oil pan 306 is then mixed with the air that comes off the hot surfaces of engine 20. This air merges in an engine air compartment 307 that is created by the molded fiberglass insulation parts 116, 118 at the hotter end of the generator set 10 nearest the outlet end 131. The air is then directed over the hot surfaces of the muffler 206 which must also be cooled. The air then exits through the base 110 of the enclosure 100 via the air outlet 154.

At the exhaust end 131 of the housing 100, the parts 116, 118 which function as noise absorbers also function as insulators to prevent the heat from the muffler 206 and the engine 20 from making the housing 100 too hot. There is a safety requirement with respect to the skin temperature of housing 100. These molded fiberglass insulating parts 116, 118 absorb both heat and noise, insulate the housing 100 from the heat so that the skin temperature is less likely to exceed the prescribed limits.

The baffle or the bulkhead 122 is releasably sealed to the fan shroud 210 by the extruded, elastomeric shroud gasket 123 that prevents recirculation of hot air from within the engine-generator compartment 135 into the cool air that is drawn in by the fan 208 from outside the set 10. This prevents overheating due to hot air recirculation and allows more efficient use of the cool outside air.

A number of components and parts that require frequent service access are grouped together just behind the service panel 162 in the cover 150 in order to facilitate easy maintenance by the user. There is also a local control panel 128 behind the panel 162. An oil fill and check port 308 is easily accessible behind panel 162 for checking and filling the engine oil. The carburetor 310 has been positioned behind the panel 162 so that the idle fuel mixture mechanism (not shown) and the main jet fuel mixture mechanism (not shown) are accessible. The low speed idle stop (not shown) is also accessible behind the panel 162. Easy access to governor adjustments is provided through the service panel 162, as well as access to a manual choke override for the automatic choke 241. Adjustments may be made to the automatic choke 241 and these controls are also positioned so that they can be accessed through the service panel 162.

The local control panel 128 consists of a start/stop switch 134 for the set 10, two fuses 136, 138 to protect a DC control circuit, and an alternating current (AC) circuit breaker (not shown) that protects the generator 40 and other powered equipment from shorts and circuit overloads. The DC fuses 136, 138 in the local control panel 128 are both 5 amp fuses. One of them protects the control circuitry within the set 10. The second one is intended to protect the wiring between the generator set 10 and a remote control panel that a customer may use to operate the set 10. Other service points behind the panel 162 include access to the engine spark plug 303 and to a fuel filter 142 which is included to remove impurities from the fuel which passes through a fuel line 143. The fuel filter 142 is easily accessed to facilitate replacement. The governor adjustments consist of governor speed and governor droop adjustment mechanisms 316 and 318 respectively, which are accessible through the service panel opening 161. The governor adjustments are made with a screwdriver through the service panel opening 161. The governor speed adjustment mechanism 316 sets the speed at which the engine 20 is operating at any given time. The governor droop adjustment mechanism 318 affects how much the speed droops or decreases as load is applied to the generator set 10. There is also an adjustment (not shown) for the choke 241. The choke adjustment 240 adjusts the preload tension on the bi-metal spring (not shown) within the choke 241 to affect how much travel the choke 241 has when it operates and to assure that the choke 241 is fully closed when it is in the closed or cold position and that it opens fully in the open position. The adjustment can be made through the service panel opening 161 with a screwdriver.

There are two ways to access the engine spark plug 303. One is through the service panel opening 161 where it can be removed with a wrench. On the outside of the base 110, an access opening 146 is provided. A metal plug 148 is engaged in the opening 146 and can be removed to allow access from outside to remove and replace the spark plug 303.

The spark plug 303 exits the cylinder head 304 of the engine 20 at about a 45° angle. The base 110 of housing 100 includes a recessed surface 315 at an angle of about 90° to the angle of the spark plug 303. The access opening 146 is located on the recessed surface 315 near the front edge of the base 110, providing easy access to the spark plug 303 when servicing the set 10 from the front or from below.

In order to modify the engine chosen for the preferred embodiment, it was decided that the generator 40 should be driven from the opposite side of the engine as would normally be used, in order to locate the heat producing engine closer to the air outlet end 131 of the set 10. This side is normally where the engine flywheel, cooling fan and ignition are located. Instead, the crankshaft 320 and the block casting were placed there so that the generator 40 could be driven from that side. This allowed the fuel system and engine carburetor 310 to be placed away from the heat of the exhaust system. This arrangement allows the fuel system to remain much cooler and also allows the set 10 to operate in a satisfactory manner without problems such as vapor lock and fuel boiling.

The engine/generator unit 200 is isolated from the housing 100 by a vibration isolation system 201 that is optimized for the particular shaking forces that are characteristic of the engine 20 that is used. This system 201 is a single plane, focalized system that uses three basic elastomeric-type, isolation mounts 202*a*, 202*b*, 202*c*, 204. Two of these mounts 202*a*, 202*b* are attached to the generator stator housing 400; the third mount 202*c* is attached to the engine oil pan 306. There is a fourth mount 204 that is actually a snubbing mount that limits overall travel of the engine-generator unit 200 mainly during start-up, shutdown and the input of road vibrations. The purpose of this is to prevent the engine-generator unit 200 from traveling within the housing 100 such that it contacts the walls of housing 100.

Figure 12:
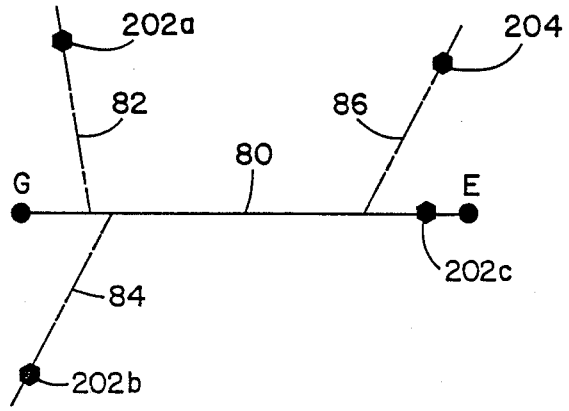
FIG. 12 is a schematic illustration of the focalized mounting system of a preferred embodiment of the present invention.

A preferred embodiment of the present invention uses a modified focalized mounting system. An embodiment of such a mounting system is illustrated in FIG. 12. The engine's center of gravity (E) and the generator's center of gravity (G) are interconnected by a line 80. The engine produces a rocking force about the line 80. A plurality of elastomeric support mounts 202*a*, 202*b*, 202*c*, 204 are used to support the generator set. The support mounts 202*a* and 202*b* are offset from the line 80 and are oriented such that lines 82, 84 drawn along their axes roughly intersects the line 80. The support mount 202*c* is vertically aligned with the line 80. The mounts 202*a*, 202*b*, 202*c* are constantly load bearing. A support mount 204 is offset from the line 80 and is oriented such that a line 86 drawn along its axis roughly intersects the line 80. The support mount 204 is not constantly load bearing and only becomes load bearing when the rocking motion exceeds a predetermined amount. The mounts 202*c* and 204 are positioned closer to the engine than the generator. The mounts 202*a* and 202*b* are positioned closer to the generator than to the engine. It will be appreciated that additional mounts might be added in keeping with the modified focalized mounting of the present invention.

The isolation system 201 is very effective in isolating more than 90% of the engine-generator unit 200 from the housing 100. This limits the vibration of the housing 100, thereby minimizing the noise that is radiated therefrom. It also allows the vibration transmitted to the RV to be at a minimum so that the user of the RV is not inconvenienced by vibration transmitted through the floor of the vehicle or noise created by vibration transmitted through the vehicle structure.

The engine 20 uses a splash lubricating system (not shown). The connecting rods and the dipper that provide the splash lubrication were modified. The engine block was modified so an external oil pan 306 could be attached to the side of the engine 20 which became the bottom of the engine 20 when it was rotated on its side.

The construction techniques used in the engine modifications were made for obvious cost efficient reasons so as to utilize the existing machine line for the engine so there would not be a need to invest in a new machine tool line to machine engine blocks. The engine design modifications were therefore made to fit within the constraints of existing machining stations.

The intake manifold 322 and the carburetor 310 were designed specifically for use in the present invention with a horizontal cylinder. The governor arm 323 and governor linkage 324 and the governor adjustment system were also designed specifically for the generator set 10 of the present invention. A spring 326 on the top of the engine 20 provides the engine speed adjustment. At one end of the spring 326 on the governor arm 324 a screw 318 is provided for adjustment of the engine droop. This screw 318 permits a nut 328 on the screw 318 to move along the length of the arm 323. Changing the position where the spring 326 pulls against the governor arm 323 changes the adjustment of the speed sensitivity of the engine 20. At the other end of the spring 326 is a lever 332 with a screw 316 on one arm of the lever 332 to pull the spring 326 to different tensions. By putting different tensions on the spring 326 the specific speed of the engine 20 can be changed. The location of both screws 316, 318 for adjustment was arranged so that they were accessible through the service panel opening 161 of the set 10, adjustments being made with a screwdriver.

The engine cooling shroud 340 that comes with the engine 20 provides air passages for the cooling air which flows over the hot surfaces 300 of the engine 20. The shroud 340 also includes a tab 341 that includes an opening 341*a* which receives the air preheater hose 342 and holds it away from the governor arm 323 so that the governor arm 323 is free to operate.

The choke lever 350 on the carburetor 310 was uniquely designed for the preferred embodiment so that users can manually override the automatic choke 241. It also has a pinched feature so that the choke lever linkage (not shown) can be installed by simply slipping the linkage into the slot and taking a pair of pliers and pinching the slot closed, thereby lowering assembly cost.

The engine 20 contains a low oil level sensing switch (not shown) in the oil pan 306 which can be used to protect the engine 20 from low oil level or loss of lubricating oil, thereby reducing warranty and/or service expenses.

A preferred embodiment of engine 20 has a solenoid (not shown) mounted on top of the engine 20 which pushes against the governor arm 323 and closes the throttle (not shown) by pulling on the throttle lever 326 when the engine 20 is stopped, avoiding afterrun of the engine 20.

A cylindrical stator or generator housing 400 is attached directly to the engine block using six mounting studs 412 and nuts 414. This housing 400 holds the generator stator 410 in place. It also has mounting feet 244 for the vibration isolation system 201 and provides for attachment of the fail safe mounting studs 246. These studs 246 permit the set 10 to pass the Federal Motor Vehicle Safety Standard §301 for fuel spillage in a crash situation.

The oil pan 306 on the engine 20 was uniquely designed for the generator set 10 of the present application. It includes fins 305 to allow greater heat transfer for cooling the engine lubricating oil. The oil filler tube 360 is uniquely designed for this embodiment to get the oil fill and check port 308 moved to the service panel side of the set 10.

The exhaust system attaches to the muffler side of the engine 20 which is the normal output side. It has two specially designed brackets 260, 262 securing the muffler 206 to the engine 20. These brackets 260, 262 required considerable development work so that any length of exhaust pipe 253 can be attached to the muffler 206. Extensive computer analysis and model analysis was done to properly design brackets 260, 262.

The muffler 206 has several special features in addition to some normal silencing features. It has a tube 252 welded onto the exhaust pipe 253 between the engine exhaust port (not shown) and the muffler 206 itself. This metal tube 252 accepts the inlet air preheater hose 342 and mixes the inlet air of the engine 20 with preheated air so that carburetor icing is avoided. This enhances the performance of the generator set 10 in low operating temperatures.

The two brackets 260, 262 are used to hold the muffler 206 to the generator set 10. The larger bracket 260 which mounts to the non-service side of the engine 20 includes two features. One feature is designed to hold the muffler 206, and the other feature is a large hole 209 that serves as a lifting eye. Bracket 260 is designed to stabilize the motion of the muffler 206 vertically and also in a torsional mode. The other bracket 262 which mounts off the gear cover (not shown) of the engine 20 is placed between the engine 20 and the muffler 206 itself. It is smaller in size than bracket 260. It supports the muffler 206 on the exhaust inlet tube side and performs a similar function in stiffening the vertical motion and torsional movement of the muffler 206.

The muffler 206 is a spark arresting type. The outlet of the muffler 206 is positioned at the bottom of the set 10 so the user can easily slip his tail pipe onto the set 10. The air outlet or exhaust hole 154 for the muffler 206 is located in the air outlet end 131 of base 110. The built in spark arresting feature is externally serviceable by removing the air outlet plate 168. The muffler 206 is of a stamped half construction which is not typical of the small engine market.

The torroidally wound generator 40 has several features that enhance the packaging in the generator set 10. The stator or non-rotating portion 410 of the generator 40 uses mag-mates (not shown) as terminations of the magnet wire 416. The mag-mates permit the wiring harness (not shown) to be mounted in the generator stator 410 in a low cost fashion. They have also been designed to be vibration resistant. These parts are normally used in the appliance industry and were adapted for use in the present invention. The outside mounting ears (not shown) of the generator stator 410 have been designed to mount the generator stator 410 into stator housing 400 in low cost fashion. In the stator housing 400 there are two cast in grooves (not shown). Projections from the mounting ears (not shown) on the outside diameter of the generator stator 410 engage the grooves to restrain the generator stator 410 from rotating in the stator housing 400. This requires no other fasteners or other assembly labor.

The torroidally wound generator 40 incorporates other system features to optimize the generator set 10 for best performance. The generator stator 410 includes quadrature windings (not shown) to provide electrical power for the revolving field alternator or generator 40. This is important during starting of an air conditioner motor. The generator 40 must produce a very high in-rush current to start the air conditioner motor. The quadrature windings provide this power independently of the output windings. The voltage output of the main windings of the generator 40 drops when the motor is turned on. If the power to the voltage regulator 180 was taken from the main AC output winding of the generator 40, its voltage would also drop and that would prevent the generator 40 from recovering from the sudden load demand. By having separate windings, the voltage is maintained during motor starting even at a higher level.

In addition to the quadrature windings, a separate capacitor (not shown) is provided on the generator set 10 of the present invention, mounted in the local control area 128. This capacitor stores electrical energy used during motor starting to provide additional energy to the generator 40 during motor starting.

The voltage regulator 180, sometimes called an AVR (automatic voltage regulator), incorporates several features to optimize its performance during motor starting. Phasing of the power signals and phasing of the switching signals is optimized for best performance. The phasing of those signals in conjunction with the capacitor sizing is optimized for best motor starting. The voltage regulator 180 contains many features which are not normally incorporated in such a device, and provides motor starting and low cost.

Figure 13:
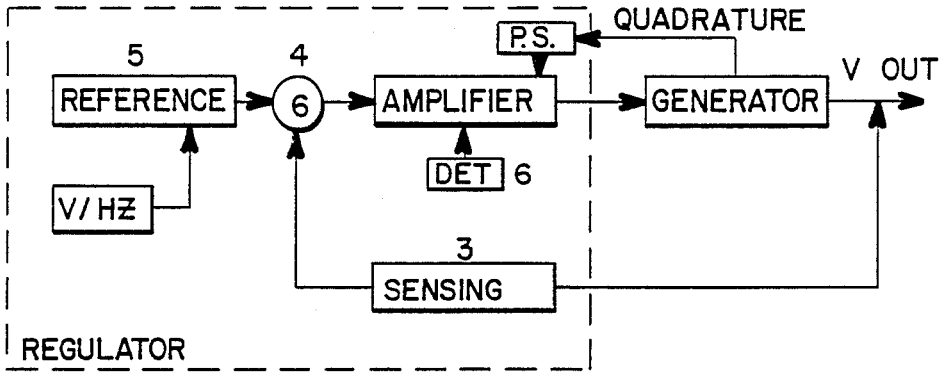
FIG. 13 is a diagrammatic illustration of a voltage regulator control system used in the present invention.

The automatic voltage regulator 180 preferably comprises six functional elements as shown in FIG. 13. The generator 40 provides an electrical output which is controlled by the magnitude of the field current. The amplifier whose input is the small "error" signal, but whose pulse with modulated output is large enough to drive the exciter field winding, derives its power from the quadrature winding. The voltage sensing circuit provides passive circuitry which takes the relatively high alternating current voltage from the main stator winding and converts it to a low direct current level proportional to generated output voltage. The comparator provides an output which is the difference between demanded voltage and reference, and is fed to the control amplifier as the "error signal". The reference is a fixed reference supply used by the comparator to determine whether the generated voltage is high or low. The crossover detector determines the firing angle of the amplifier by sensing the power excitation voltage. There are two areas in the local control 128 in which it is possible to provide the means for output voltage adjustment. The voltage sensing circuit comprises an attenuation whose "dividing ratio" can be adjusted to provide output voltage adjustment. It is clear that error must be very small compared with demand and actual, and hence the latter must remain constant. By adjusting the input scaling, the output voltage is adjusted.

Figure 14:
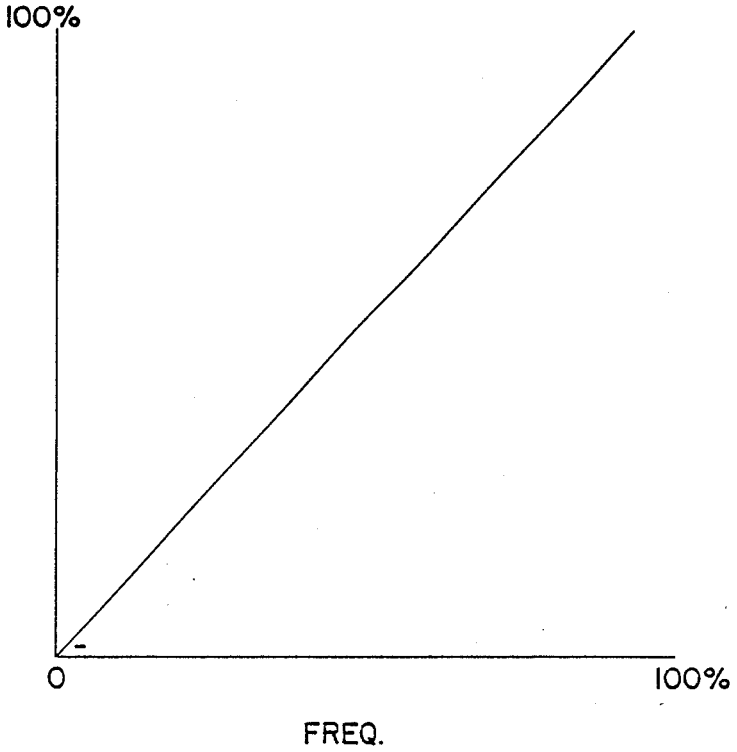
FIG. 14 shows a typical performance curve for the voltage regulator illustrated in FIG. 15.

It is possible, by introducing reactive elements into the voltage sensing circuit, to provide frequency sensing into the characteristic of the loop. A typical performance curve is shown in FIG. 14. While providing instant relief against high kilowatt transient loads, this feature has the disadvantage of degrading the regulation of the generator and giving some error in the input scaling. This is the way that the voltage regulator 180 provides frequency rolloff. The biggest source of error, though, is the reference zener.

Figure 16:
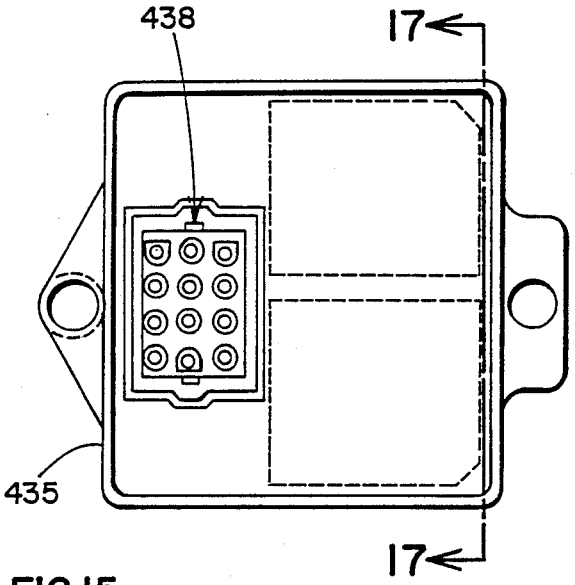
FIG. 16 is a plan view of a voltage regulator housing.
Figure 17:
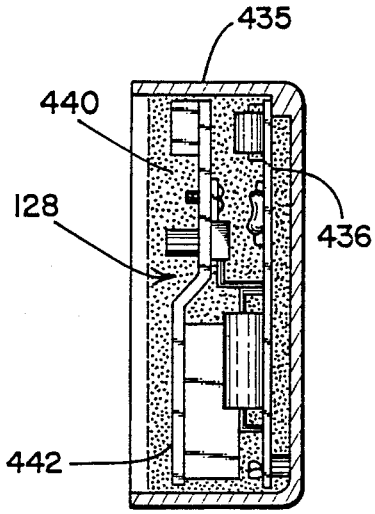
FIG. 17 is a view as seen generally along line 17—17 of FIG. 16.
Figure 15:
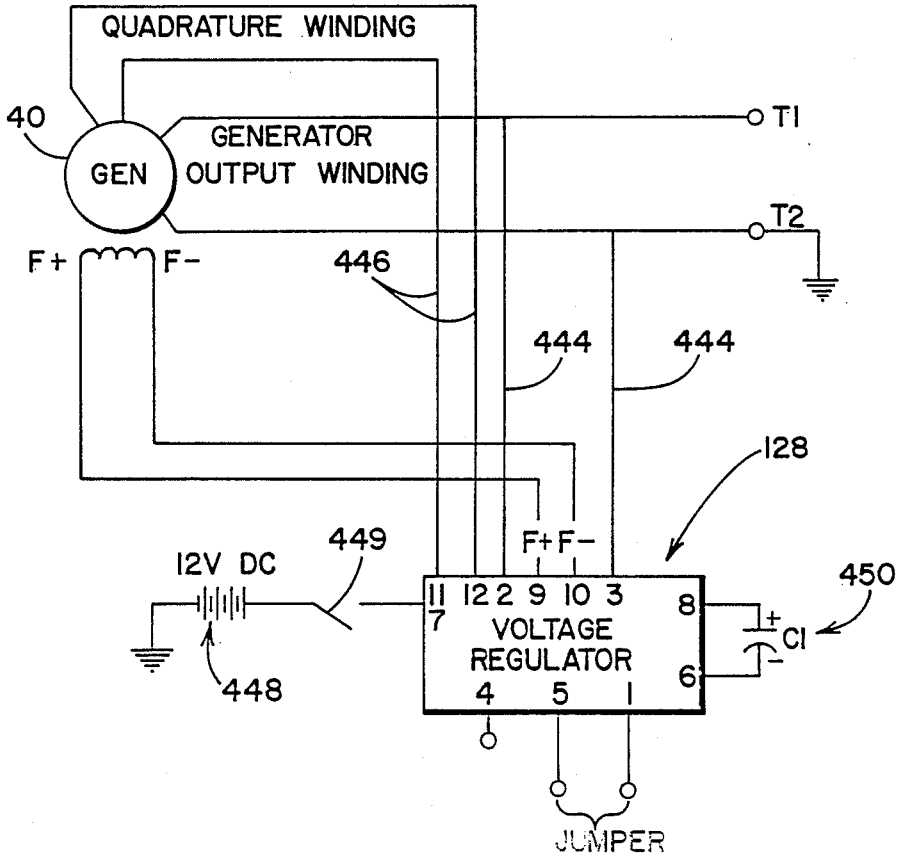
FIG. 15 is a schematic view of one embodiment of a voltage regulator control system in accordance with the principles of the present invention.

Illustrated in FIG. 15, is a schematic diagram of an embodiment of the generator 40 and the voltage regulator control system 128. FIGS. 16 and 17 illustrate an embodiment of a housing 435 used to mount the voltage regulator control system on the generator set at a suitable location. The voltage regulatory circuitry is mounted on a printed circuit board 436 and is sealed in a potting material 440. A heat sink 442 is provided as well as an electrical connector panel 438. The potting material 440 provides a water tight seal and helps to dampen vibrations. In FIG. 15 the sensing lines 444 coming from the generator output winding and the excitation lines 446 coming from the generator quadrature winding are illustrated. In addition, a twelve volt battery 448 and switch arrangement 449 are present for providing the initial excitation current upon start-up of the generator set. Once the generator is running, the switch 449 is open and the excitation energy is derived from the quadrature winding of the generator 40. A capacitor 450 is also present for providing additional current when extra large loads are placed on the system, such as when starting an air conditioner or the like.

The starter motor 264 of generator set 10 engages a die cast ring gear 212*b*. Reciprocal gear teeth are preferably die cast onto the flywheel 212*a* to form a single integral unit, rather than being machined in, as is often done. The preferred starter motor 264 has a plastic gear 266 which is not the normal method of making gears, but it is compatible with the die cast ring gear 212*b* of the flywheel 212*a*. The flywheel 212*a* including the die cast ring gear 212*b* also serves as a fan carrier. It is the mounting hub for the plastic cooling fan 208. It also serves as a carrier for magnets for the magneto ignition (not shown). The generator set 10 uses a magneto ignition with permanent magnets mounted in the flywheel 212*a*.

The ignition is a low cost system used on chain saws and is not normally of the type used on a generator set. Chain saws are normally two-cycle engines. The engine 20 of the preferred embodiment is a four-cycle engine. The ignition requirements for a two-cycle engine are much more severe than a four-cycle engine. By using the two-cycle ignition on the four-cycle engine 20, the reliability and starting performance of the generator set 10 of the present invention have been greatly improved. In addition, these components were optimized to provide extremely light weight, and several pounds were saved in the final generator set 10 assembly weight by use of these components.

The air filter assembly 270 in the generator set 10 uses a paper element air filter 272 that has a plastisol molding compound on the air filter 272 as one sealing surface. The other end of the air filter 272 has a metal plate on it. The air filter 272 mounts into a plastic air filter housing 271 in the fan shroud 210. The air filter 272 is held in place with a spring steel wire clip 274 that permits a positive seal of the air filter 272 and is also user friendly.

The air filter assembly 270 includes a service door 276 which is tightly sealed so that air cannot come in when the service door 276 is closed. This allows combustion air to be drawn into the filter assembly 270 from the cooling fan 208 via a valve 273 mounted in the fan shroud 210. The combustion air is pulled into the engine 20 through the air preheat hose 342 or from the tube 252 on the exhaust pipe 253, as discussed hereinabove in connection with the discussion of the muffler 206. By totally enclosing the air filter 272 within the air filter housing 271 and having a tight fitting door 276, it was possible to provide temperature control in the air filter 272 and in the engine 20 for both summer and winter operation. During winter operation the air is pulled over the exhaust system via the tube 252 so that it is preheated in order to prevent carburetor icing. In summer operation air is pulled from the cooling fan 208 which essentially has direct access to outside air. The lower temperature results in higher engine power and better engine performance at higher temperatures. Adjustments may be made to the valve 273 to control the air source.

After the generator stator 410 and rotor 420 are installed in the generator housing 400 which has been bolted to the engine 20, the end bell 230 is attached to the stator housing 400. The end bell 230 contains several parts. It mounts the starter motor 264. It includes four springs 288 which push against the generator stator 410 mounted in the stator housing 400, and as a result the generator stator 410 is retained in the stator housing 400 with no additional fasteners. This further lowers the assembly cost of the preferred generator set 10. The end bell 230 also contains a brush block (not shown), a magneto stator section (not shown) and an air preheater opening 282 for receiving the air preheater 342. It also includes a feature to seal against the carburetor 310 and to seal against the air filter assembly 270 so a low cost method of sealing the combustion air from the carburetor 310 to the air filter assembly 270 without additional parts or hose clamps is provided. The air preheater opening 282 holds the air preheater hose 342 and directs the preheated air into an air preheat valve 273. The end bell 230 also has a breather hose opening 283 for receiving the breather hose 370 so that the engine crankcase fumes from the engine crankcase can be directed into the carburetor air for burning in the engine 20. The end bell also has a large round opening 284 that is provided for lifting the generator set 10. This opening 284 in conjunction with the hole 209 on bracket 260, which holds the muffler 206, provide lifting eyes for the generator set 10. A carburetor air hole 285 is also provided in the end bell 230 in close proximity to the breather hose opening 283 so that air from the breather hose 370 can go through the air hole 285 without having to go through the air filter 272 which seals an area surrounding the air hole 285 and the breather hose opening 283. The other side of the end bell 230 that does not go against the stator housing 400 has snap fit features 374 incorporated therein which cooperate with snap fit receiving features 375 on the fan shroud 210 so that the fan shroud 210 can be assembled to the end bell 230 with no additional fasteners or expense.

The major function of the end bell 230 is to hold the bearing ring 425 of the generator 40. The end bell 230 has a cast-in powdered metal ring 286 which supports the generator bearing ring 425. The powdered metal ring 286 has a groove 290 in it which holds an O-ring (not shown). This allows the generator bearing ring 425 to lightly seat in the powdered metal ring 286 with a small clearance. The O-ring prevents the bearing ring 425 from rotating within the bearing bore 289 in the endbell 230 and prevents wear. The seal friction of the bearing ring 425 is high enough that the bearing ring 425 will rotate within the bearing bore 289 without this O-ring feature.

The endbell 230 includes a feature for support of the engine cooling air duct 214. This is a black plastic duct which attaches to the engine sheet metal 278, and it also snap fits against the end bell 230 proximate the engine air duct opening 213. This provides a low cost method of ducting the air from the cooling fan 208 into the engine 20.

The flywheel assembly 212 includes a die cast ring gear 212*b* which performs several functions. The starter gear teeth 212*c* are cast into this device. It holds the permanent magnets for the magneto. It has a powdered metal insert (not shown) to mount against the tapered end 422 of the generator shaft 423. It has a keyway (not shown) for proper alignment with the generator shaft 423 to maintain ignition timing. The crankshaft 320 of the engine 20 has a keyway (not shown) to mate with a keyway (not shown) in the generator shaft 423. The generator shaft 423 has keyways (not shown) at both ends so that the ignition timing is properly maintained between the engine 20 and the flywheel 212*a*. The flywheel carrier/fan hub (not shown) mounts the plastic fan 208 that provides the cooling air for the generator set 10. Cast into the flywheel assembly 212 is an appropriate amount of counterweight to properly offset the weight of the magnets so that the part is balanced as cast and requires no balancing after the casting operation, thereby lowering the factory cost of this part.

The one piece fan shroud 210 also incorporates features so it can be snap fit into the end bell 230. It includes a feature to protect the operator from accidentally touching the starter gear 266, and incorporates a mechanism for selecting combustion air or preheated air into the air filter housing 270 (see discussion of valve 273). These components snap fit into the plastic fan shroud 210. It contains features to seal the perimeter of the air filter 272 so that the air into the filter 272 is either from the air preheater 342 or from the cooling fan 208.

On the top 224 of the fan shroud 210 directed toward the baffle 122, there is an extruded lip seal or gasket 123. This lip seal 123 serves two functions. It helps contain the noise produced by the generator set 10 within the housing 100, and it also prevents the hot air that surrounds the generator 40 from reentering the cooling fan 208 and being used for engine cooling.

The extruded seal or gasket 123 is made out of a very flexible material. The extrusion manufacturing process results in the seal 123 being produced in a large reel. The material is cut to length and inserted in a non-symmetrical barb (not shown) on the inside diameter of the fan shroud 210. The extruded seal 123 has appropriate features built within it to snap over the barb to provide a tight fit. Due to the cost of this seal 123, the extrusion manufacturing process was chosen so that the seal 123 could be produced in long reels at low cost with low cost dies. The extruded seal or gasket 123 is installed around the entire inlet perimeter 223 of the fan shroud 210 so that the seal or gasket 123 totally seals noise and prevents cooling air recirculation problems.

Unique aspects of the generator 40 are the interface points between the wound rotor 420 and generator stator 410. This would include the mag-mates, the mounting ears, the outside diameter of the stator 410, the mag-mates between the rotor coils 428 and the slip rings 424 and the keyways (not shown) in the generator shaft 423 to provide improved ignition timing between the engine 20 and the magneto on the flywheel 212*a*.

The fuel pump 124 is mounted in a very unique orientation. The fuel pump 124 is positioned in what would normally be considered an upside down position in that the inlet (not shown) is in the bottom of the pump 124 and the outlet 125 is at the top. This requires use of additional tubing lines 126 to be used to get fuel in and out of the pump 124. However, because of the internal operation of the pump valving system, this orientation permits the pump 124 to purge itself of vapor and greatly enhances the vapor lock performance. This is not a conventional way of mounting or using a fuel pump 124.

The baffle 122 also mounts the start solenoid 172 which contains several fast-on connector assemblies 174 to lower the factory cost of the wiring harness (not shown). Some of the fast-on blades have bent tabs to prevent the tabs from rotating during the tightening operation (not shown). This also lowers the factory cost of assembling these parts. The inlet baffle 122 also has a special slot 157 through which the wiring harness (not shown) passes. The slot 157 lowers the factory cost of the wiring harness assembly and contains a uniquely shaped plastic grommet (not shown) to protect the wiring harness and to provide some retention features so the wiring harness can be pushed into the slot 157 and not fall out.

Rubber grommets (not shown) are mounted around the fuel lines and slip into slots in the baffle 122 to stabilize them. This adds to safety and cost efficiency.

The control assembly 128 incorporates several unique features to lower its cost and enhance its performance. A custom plastic socket (not shown) is designed to hold the wiring harness onto a plug-in relay (not shown). This socket has long fingers molded into it to snap fit the socket onto the relay so that vibration and mishandling of the generator set 10 do not pull the socket off the relay. The assembly also uses significant amounts of high volume wiring harness hardware to lower the costs and simplify the wiring harness construction.

The control assembly 128 features stop/start logic. The innerlock protection on starter motor 264 reengagement are all provided within the wiring harness. The wiring harness concept permits logic to be provided by a low number of relays in addition to a few selected diodes. The harness provides a great deal of performance and function at low cost.

The muffler 206 performs two functions. The muffler 206 holds a tube 252 on which to mount a preheater 342 and it silences engine exhaust. Mufflers are normally built by rolling a metal tube into a circular or oval shape and stuffing baffles inside that metal tube and welding end caps onto the tube. This muffler 206 is not circular or oval but is a flat construction. The baffles are assembled as a subassembly and put within the two stamped halves, and the halves are assembled in a single crimping operation. The muffler 206 incorporates spark arresting features to comply with USDA Forestry Service requirements. The muffler 206 and supporting brackets 260, 262 combine to serve as a structural member that supports an exterior exhaust pipe or tail pipe (not shown) which would normally be attached to the muffler exhaust pipe 254 that must go from the generator set 10 to the perimeter of the RV. The exterior exhaust pipe 254 varies significantly in length from being very short to being very long and complex in shape. The muffler 206 must serve as a structural member to support the weight of the exterior exhaust pipe. This is provided so that in the present invention there are no special requirements for the installer of the generator 40.

The base 110 used on the generator 40 is a very complex drawn sheet metal part incorporating numerous features into one component. There are three large bosses 190, 191, 192 stamped in the base 110 including small holes 190*a*, 191*a*, 192*a* for the mounts 202*a*, 202*b*, 202*c* and large holes 190*b*, 191*b*, 192*b* in the bosses 190, 191, 192 to receive the fail safe mounting studs 246 attached to the generator 40. Also, a fourth boss 193 is provided within the base 110 to receive the fourth mount 204 on the generator 40 that controls the motion of the generator 40. Another stamped feature 197 mounts the voltage regulator 180. Additional shapes in the base 110 are used to provide dams and drainage passages to collect gasoline fuel and engine oil spillage. Codes require that engine oil and gasoline fuel be collected and drained away from the exhaust system. This is accomplished by stamping in raised portions and depressed portions in the base 110 to incorporate this oil and fuel drainage feature at no additional cost. A drain hole 195 is also provided. Other features are incorporated in the base 110 to locate and mount the acoustical insulating parts 114, 116, 118 used for the cooling air discharge passage and for the air entry. The following additional features are also incorporated in the base 110 for mounting. Four weld nuts 194 are used on the bottom of the base 110 for mounting the generator set 10 on a vehicle floor. The weld nuts 194 are placed two at either end of the base 110 for underfloor mounting of the generator set 10 and an additional weld nut 196 is mounted on the back of the generator set 10 as a grounding point for ground straps. In addition, four sheet metal tabs 182 are spot welded to the base 110 to allow the cover 150 to be to the base 110 and provide alignment of acoustical insulating parts 114, 116, 118. It also incorporates a hole 199 to access an oil drain (not shown) in the oil pan 306 attached to the bottom of the engine 20.

Two symmetrical brackets (not shown) are used to mount the generator set 10 in an underfloor installation in an RV. The two symmetrical brackets mount to additional weld nuts (not shown) on the exterior of the ends of the base 110. The symmetrical brackets permit the bracket unit to be attached to the generator set 10 with its top flanged area either over the top of the generator set 10 resulting in a compact use of the underfloor space, or they may be mounted 180° the other direction so they occupy more floor space under the RV, but permit easier service access to the mounting bolts that hold them to the RV. Because the brackets are designed with symmetry, their installation requires no education or training at the assembly level for the RV manufacturer's personnel. The brackets also incorporate two stamp features to provide additional stiffness and strength during use over rough roads. The brackets are designed to be stamped parts and have spot welded reinforcing tangs (not shown) for additional strength.

It is to be understood, however, that even though these numerous characteristics and advantages of the invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A generator set, comprising:

(a) a horizontally disposed internal combustion engine including a drive shaft rotatable by the engine;

(b) generator means interconnected to a crankshaft of the engine for converting the mechanical rotational motion of the drive shaft into electrical energy;

(c) rotatable fan means rotated by the engine for cooling the generator set, the generator means being disposed intermediate of the fan means and the engine, the fan means including air flow separator means for separating air flow into a first air flow for cooling the engine and a second air flow for cooling the generator means;

(d) exhaust means for exhausting used gases which are byproducts of the combustion process, the exhaust means including a muffler means for deadening exhaust noise, the muffler means being located on a side of the engine opposite that of the generator means and the fan means; and (e) a single enclosure enclosing the engine, generator means, fan means, and exhaust means, the enclosure including an air inlet and an air outlet, the air inlet being located on a side of the engine where the generator means and fan means are located, the air outlet being located on a side of the engine where the muffler means is located.

2. A generator set in accordance with claim 1, wherein a "line of sight" between noise generating sources inside the enclosure and the air inlet and the air outlet is blocked, thereby facilitating noise reduction.

3. A generator set in accordance with claim 2, wherein baffles are present for blocking the "line of sight" to the air outlet.

4. A generator set in accordance with claim 1, wherein the air flow separation means includes a shroud including first and second expanding radii, the first and second expanding radii including first and second cutoff means, respectively, for forcing the air along the first air flow path and the second air flow path, respectively.

5. A generator set in accordance with claim 4, wherein the fan means is interconnected to a rotatable extension of the generator means.

6. A generator set in accordance with claim 4, wherein the first air flow path is routed largely through the generator means and across an oil sump of the engine and the second air flow path is routed along the side of the generator means over a carburetor of the engine and across a finned portion and a cylinder head of the engine.

7. A generator set in accordance with claim 1, wherein polymeric acoustical foam and glass fiber are present in cooler areas of the generator set, and fibrous high temperature materials are present in hotter areas of the generator set.

8. A generator set in accordance with claim 1, wherein elastomeric mounts support the generator means and engine, a plurality of said elastomeric mounts being offset from a "rocking" line interconnecting a center of gravity of the generator means and a center of gravity of the engine, longitudinal axes of the offset elastomeric mounts extending roughly through the "rocking" line, at least one of the elastomeric mounts only supporting the generator means and engine when rocking about the "rocking" line exceeds a predetermined amount.

9. A generator set in accordance with claim 8, further including at least one elastomeric mount in substantial vertical alignment with the "rocking" line.

10. A generator set in accordance with claim 1, wherein the enclosure includes a base portion, a top portion, and a removable panel portion, the air outlet being located in the base portion.

11. A generator set in accordance with claim 10, wherein the muffler means has a vertical orientation.

12. A generator set in accordance with claim 1, wherein the generator set further includes control circuit means for regulating the voltage output of the generator set, the control circuit means including:

(a) a quadrature winding on the generator means;

(b) amplifier circuitry electrically interconnected to the quadrature winding, the quadrature winding providing an electrical input to the amplifier circuitry;

(c) voltage sensing circuitry electrically interconnected to the electrical output of the generator means, the voltage sensing means including means for converting AC voltage of the generator means electrical output to a low DC voltage output proportional to the electrical output AC voltage;

(d) reference circuitry means for providing a reference voltage output;

(e) comparator circuitry means electrically interconnected to the reference circuitry means and the voltage sensing circuitry for comparing the output of the reference circuitry means and the voltage sensing circuitry, the comparator circuitry means being electrically interconnected to the amplifier circuitry for outputting to the amplifier circuitry a signal representative of the difference between the voltage sensing circuitry output and the reference circuitry means;

(f) the amplifier circuitry including output means for outputting a pulse width modulated signal for driving exciter windings of the generator means; and (g) crossover means electrically interconnected to the amplifier for determining the angle at which the amplifier output means is activated.

13. A generator set in accordance with claim 12, wherein the control circuit means includes a DC power source means for providing a voltage to the amplifier circuitry upon initial start-up of the generator set and further including capacitor means for providing additional current when excessive loads are placed on the generator set.

14. A method of making a generator set, comprising the steps of:

(a) mounting an engine with its cylinder in a horizontal orientation;

(b) interconnecting generator means to a crankshaft of the engine for rotation therewith;

(c) interconnecting fan means to a rotatable extension of the generator means for rotation therewith, the generator means being disposed intermediate of the engine and the fan means;

(d) interconnecting exhaust means to the engine for exhausting used gases, providing the exhaust means with muffler means for deadening exhaust noise, positioning the muffler means on a side of the engine opposite that of the generator means; and (e) enclosing the engine, generator means, fan means, and exhaust means within a single enclosure including a top portion and a base portion, the enclosure including an air inlet on a side of the engine where the fan means and generator means are located and further including an air outlet on a side of the engine where the muffler means is located.

15. A method in accordance with claim 14, including blocking "line of sight" between the air inlet and the air outlet and noise generating sources inside the enclosure.

16. A method in accordance with claim 15, wherein the step of blocking the "line of sight" includes blocking the "line of sight" between the air inlet and the generator means and blocking the "line of sight" between the air outlet and the engine.

17. A method in accordance with claim 14, wherein the step of interconnecting the fan means includes the step of providing a structure for separating incoming air flow from the air inlet into first and second air flows, the first air flow cooling the engine and the second air flow cooling the generator means.

18. A method of making a generator set, comprising the steps of:

(a) mounting an engine with its cylinder in a horizontal orientation;

(b) interconnecting generator means to a crankshaft of the engine;

(c) interconnecting fan means to a shaft extension of the generator means for creating an air flow generally in a downstream direction so as to cool the generator set, the generator means being disposed intermediate of the engine and the fan means, providing the fan means with air flow separation means for separating the air flow generally into first and second air flows, the first air flow cooling the engine and the second air flow cooling the generator means;

(d) interconnecting exhaust means to the engine for exhausting used gases from the engine, the exhaust means including muffler means for deadening exhaust noise;

(e) positioning the muffler means downstream from the fan means and the generator means; and (f) enclosing the engine, generator means, fan means and muffler means within an enclosure including an air inlet and an air outlet.

19. A method in accordance with claim 18, including the step of orienting the muffler means in a vertical orientation.

20. A method in accordance with claim 18, wherein the step of enclosing includes creating a two-piece enclosure having a base and a cover, forming the base from sheet metal and the cover from plastic, and placing gasket material along abutting surfaces of the base and cover.

* * * * *

UNITED STATES PATENT AND TRADEMARK OFFICE

CERTIFICATE OF CORRECTION

PATENT NO. : 4,835,405

DATED : May 30, 1989

INVENTOR(S) : Clancey et al.

It is certified that error appears in the above-identified patent and that said Letters Patent is hereby corrected as shown below:

Front page, Inventors, "Stanely" should be --Stanley--

Col. 6, line 32, "net" should be --not--

Col. 8, line 30, "show" should be --shown--

Col. 14, line 21, "winding" should be --windings--

Col. 16, line 44, "endbell" should be --end bell--

Signed and Sealed this

Thirtieth Day of April, 1991

*Attest:*

HARRY F. MANBECK, JR.

*Attesting Officer*

*Commissioner of Patents and Trademarks*